United States Patent [19]

Beckett et al.

[11] 4,102,660

[45] Jul. 25, 1978

[54] ICE GUIDE FOR REFRIGERATOR WITH EXTERNAL ICE SERVICE

[75] Inventors: Leo Gano Beckett, Henderson, Ky.; William J. Buchser, Evansville, Ind.

[73] Assignee: Whirlpool Corporation, Benton Harbor, Mich.

[21] Appl. No.: 718,144

[22] Filed: Aug. 26, 1976

[51] Int. Cl.[2] ..... F25C 1/00

[52] U.S. Cl. ..... 62/344; 222/461; 221/311

[58] Field of Search ..... 62/344, 265; 222/461; 221/311; 141/360, 362

[56] References Cited

U.S. PATENT DOCUMENTS

| | | | |
|---|---|---|---|
| 3,059,450 | 10/1962 | Mueller et al. | 62/344 |
| 3,254,802 | 6/1966 | Barnes | 222/181 |
| 3,942,334 | 3/1976 | Pink | 62/344 |

*Primary Examiner*—William E. Wayner

*Attorney, Agent, or Firm*—Wegner, Stellman, McCord, Wiles & Wood

[57] ABSTRACT

Structure for controlling the delivery of ice pieces for external service with the ice pieces being formed within a refrigerator or the like. The apparatus may include a closure for selectively closing the end of a delivery chute through which the ice pieces are conducted during the delivery operation. Delivery of the ice pieces is effected by movement of an actuator as by a receptacle, such as a cup or glass, being urged thereagainst to receive the delivered ice. Movement of the actuator concurrently moves the closure away from the delivery chute and positions a guide in cooperation with the closure to guide the ice pieces from the end of the delivery chute into the receptacle. The guide may include upstanding side wall portions for preventing undesirable lateral discharge of the ice pieces and effectively assuring the delivery of all of the ice pieces into the receptacle. The guide may comprise a one-piece element removably installed on the actuator for movement therewith. The actuator and guide mounted thereon may be biased to an outwardly directed disposition whereby the guide further serves to direct the last-delivered ice pieces toward the receptacle as it is being removed from engagement with the actuator. The closure may be biased to close the delivery chute upon completion of the ice piece delivery operation.

18 Claims, 7 Drawing Figures

19
21
56
57
58
55
54
59
32
30
3.
45
51
47
53
50
49
16
34
29
33
40
73
35
48
39
36
41
63
46
65
67
70
69
66
44
43
38
37
18
17

14
21
37
36
35
29
30
31
24
25
15
22
16
50
49
48
40
52
51
39
73
38
45
27
26
23
28
64
64
47
46
71
60
65
62
63
15
68
66
67
44
18
43
20

ICE GUIDE FOR REFRIGERATOR WITH EXTERNAL ICE SERVICE

BACKGROUND OF THE INVENTION

1. Field of the Invention

This invention relates to refrigeration apparatus and in particular to apparatus for deliverying ice pieces to an external service area.

2. Description of the Prior Art

In one conventional form of refrigerator, ice pieces are formed within the refrigerator and delivered through the door of the refrigerator to an exterior service area. Conventionally, the ice forming apparatus is provided in the freezer section of the refrigerator and the door is provided with a delivery chute extending from the ice maker. The front opening of the delivery chute is conventionally closed by a suitable closure to prevent ingress of ambient air other than during an ice piece delivery operation.

The conventional delivery chute is inclined forwardly downwardly through the door to facilitate a delivery of the ice pieces through the front opening.

Conventionally, the apparatus is provided with an actuator which, when engaged by a suitable receptacle, such as a cup or glass, effects operation of the ice piece delivery means for delivering ice from the ice piece maker through the delivery chute and front opening thereof into the receptacle.

In one form of such apparatus, the actuator effects a positive movement of the chute closure away from the closure front opening to facilitate the delivery of the ice pieces by gravity downwardly from the chute into the receptacle.

A number of different prior art devices have been developed for controlling delivery of particulate material and the like in dispensing service. Illustratively, in U.S. Pat. No. 3,254,802 of Randall C. Barnes, a powdered food dispenser is illustrated having an actuator adapted to be engaged by a cup so that when the actuator is urged rearwardly by the cup, a spring-biased closure is pivoted downwardly to direct powdered material from the storage means into the cup. The closure further defines an ejection chute having side walls for guiding the powdered material downwardly into the cups. The actuator is spring-biased away from the chute control lever, and upon removal of the cup from the dispensing position, is retracted to permit the closure to swing up to a closed position across the bottom opening of the storage means.

Robert Coucher, in U.S. Pat. No. 3,612,364, shows a skip-loading gate employed in mines and other industries having a movable spout at the lower end of the chute and positioning means for selectively positioning the spout in a retracted position within the chute and an extended position extending forwardly downwardly from the chute to adjacent a receiving bucket.

In U.S. Pat. No. 3,640,088 of Dwight W. Jacobus et al, a through-the-door refrigerator ice delivery service is illustrated having a plurality of flexible fingers serving to direct the ice pieces into the subjacent receptacle. Movement of the receptacle into the service area causes a depression of a plunger so as to actuate the control switch means of the dispensing motor and concurrently pivot the chute closure member downwardly by means of a cable linkage mechanism. The flexible fingers are arranged in a funnel-shaped configuration and are fixedly secured to the structure at the lower end of the chute.

Joel A. Gittelson et al, in U.S. Pat. No. 3,718,237, show a similar arrangement having an improved form of closure element.

In U.S. Pat. No. 3,918,617 of F. Browne Gregg, apparatus for dispensing fluent material from a hopper or other source of supply is disclosed as including a gate mechanism which is adjustable to control the flow of the material while an associated chute mechanism remains in an operative position. The gate automatically moves the chute mechanism to an inoperative position when the gate is substantially closed by means of a hydraulic cylinder.

In U.S. Pat. No. 3,572,053 of Dwight W. Jacobus et al, a through-the-door ice piece dispenser is shown having an operating means on the outer surface of the door for energizing the dispenser. Means are provided for closing the door passage when the dispenser is not energized. In one embodiment, the inlet to the door passage is selectively closed by a closure which is pivotally mounted on an inner panel of the door and biased to the closed position. A chute is mounted on the closure to be disposed for guiding the ice pieces into the passage within the door.

SUMMARY OF THE INVENTION

The present invention comprehends an improved apparatus for use in such ice piece delivery systems wherein delivery of ice pieces is effected automatically by the placement of a receptacle, such as a cup or glass, against an actuator exposed exteriorly of the refrigeration apparatus cabinet. More specifically, the invention is directed to the use of such apparatus in connection with such ice piece delivery means wherein the ice pieces are delivered through a chute in the door of the refrigeration apparatus.

The invention comprehends an improved means for guiding the delivered ice pieces effectively positively into the receptacle from the outer opening of the door chute. The outer end of the door chute may be selectively closed by a closure which is opened concurrently with the initiation of the ice delivery through the chute.

Guide means are associated with the actuator so as to be suitably positioned concurrently with the delivery of the ice pieces to provide improved guiding of the ice pieces into the receptacle. The closure may cooperate with the guide element to define effectively an extension of the door chute during the ice delivery operation.

The guide element may be provided with upstanding side wall portions for effectively precluding lateral discharge of ice pieces and assuring delivery of the ice pieces to the desired receptacle.

The guide may be relatively wide to assure the improved desired delivery of the ice pieces into the receptacle.

The guide may be removably mounted to the actuator for movement therewith. In the illustrated embodiment, the guide is provided with interlocking means and shoulder means cooperating with different portions of the actuator to effect the desired removable installation thereof on the actuator.

The guide may include a rear wall having means defining a channel embracing a tongue portion of the actuator for improved mounting of the guide on the actuator. A stop shoulder may be provided on the rear wall of the guide, and in the illustrated embodiment, is defined by a notch in the lower portion of the rear wall channel means.

The actuator may be provided with a stop for cooperation with the stop shoulder of the guide in positioning the guide on the actuator and in opposition to the biasing action of the resilient interlock fingers defining the interlock means.

The actuator stop may further define means for limiting the movement of the receptacle along the actuator in effecting the actuating movement thereof by the receptacle. The stop effectively causes the receptacle to be suitably positioned below the guide for receiving the guided ice pieces for further improved delivery operation.

The actuator may be pivotally mounted and the guide, in being movable with the actuator is correspondingly swung about the pivot axis to the ice piece guiding position. Upon release of the receptacle from the actuator, the actuator is biased outwardly and thus the guide is swung outwardly concurrently so as to provide an improved guided delivery of the last ice pieces into the receptacle being so withdrawn. The guide is further arranged so as to deflect the ice pieces forwardly into the receptacle as it is being withdrawn to provide a further improved guiding functioning.

The dual functioning of the closure element to provide the desired closing of the ice delivery door chute when ice piece delivery is not being effected and its cooperative association with the guide for effectively defining therewith the extension of the door chute, provides a further improved ice delivery functioning in the present apparatus. The guide may comprise a one-piece element formed of molded synthetic resin and, thus, is extremely inexpensive and simple of construction while yet providing the highly desirable ice piece guiding functioning discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
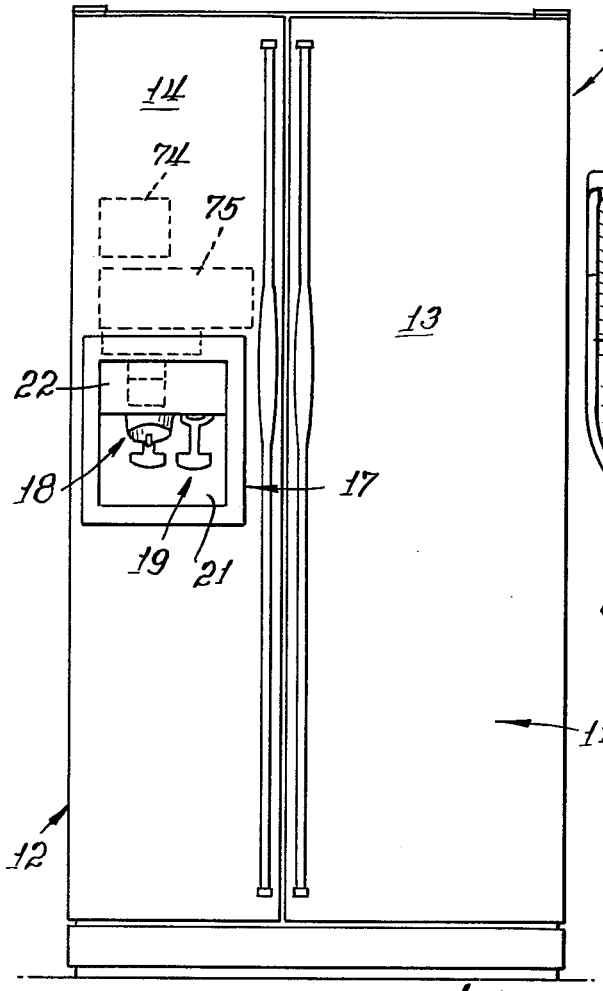
FIG. 1 is a front elevation of a refrigerator having a through-the-door ice delivery means provided with guide means embodying the invention.

In the exemplary embodiment of the invention as disclosed in the drawing, a refrigerator generally designated 10 is shown to comprise a side-by-side refrigerator having an above-freezing temperature portion 11 and a freezer portion 12 provided, respectively, with front doors 13 and 14.

Figure 3:
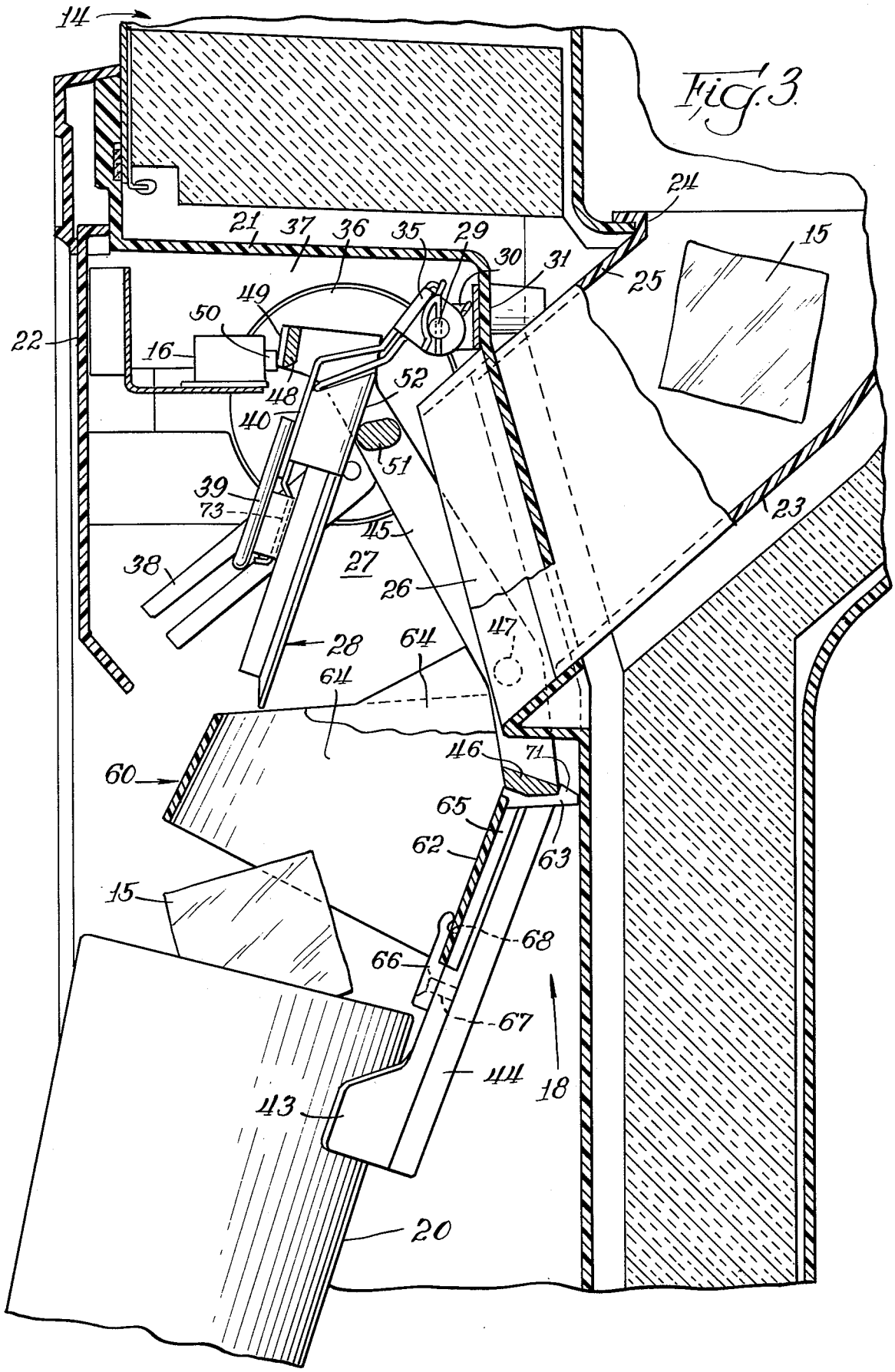
FIG. 3 is a fragmentary vertical section thereof illustrating the arrangement of the apparatus during an ice piece delivery operation.

The freezer portion 12 of the refrigerator may be provided internally with a conventional ice piece maker 74 for automatically forming a plurality of ice pieces, such as ice pieces 15 illustrated in FIG. 3. The ice maker may comprise any conventional ice maker, and in the illustrated embodiment, an electric switch 16 is provided for controlling the delivery of ice pieces from the ice maker in a conventional manner. The freezer portion 12 also contains a conventional ice dispensing apparatus, shown generally at 75.

As shown in FIG. 1, the freezer door is provided with additional ice dispenser means generally designated 17 including an ice piece dispensing portion 18 and a refrigerated water dispensing portion 19. The present invention is concerned with the delivery of the ice bodies 15 through dispenser 18 to a suitable receiving receptacle 20, such as a cup or glass. As shown in FIG. 1, the dispenser 17 includes a forwardly opening housing 21 mounted in a suitable recess in the door 14 and provided with a decorative upper panel 22.

As best seen in FIG. 3, the door 14 is provided with a chute 23 having an inlet portion 24 for receiving the ice pieces 15, a tubular portion 25 for conducting the ice pieces through the door, and a front portion 26 defining an outlet opening for delivering the ice pieces to the ice service area generally designated 27 within the housing 21.

The outlet opening 26 of the chute 23 is selectively closed by a closure generally designated 28. A pivot rod 29 is carried by a bracket 30 secured to the rear wall 31 of the housing 21 by suitable screws 32. The closure 28 is mounted for pivotal movement about pivot rod 29 by means of a carrier element 73. A coil spring 33 is coaxially mounted about the pivot rod 29 and includes a U-shaped midportion 34 which bears against a portion 35 of a follower 40 which overlies the closure 28 to engage and pivot the closure in a counterclockwise direction, as seen in FIG. 3, to a closed position across the chute outlet opening 26. A time delay device 36 is mounted to the side wall 37 of the housing 21 and includes a connecting arm 38 movably connected to a connector 39 secured to the follower 40 of the closure 28. As shown in FIG. 3, arm 38 is bifurcated for receiving the end of the connector 39 slidably in providing the desired interconnection between the time delay device 36 and the follower 40. The action of the spring 33 in returning the follower 40 to the closed position across opening 26 from the open position shown in full lines in FIG. 3 is retarded by the device 36. Delay device 36, however, is arranged to permit substantially unimpeded swinging of the closure 28 to the open position of FIG. 3 from the closed position of outlet 26. In addition, since the delay device 36 is connected to follower 40 rather than to the closure 28, the closure will swing shut freely under the influence of gravity immediately upon release of the dispenser actuating means shown generally at 41. For a more detailed description of the operation of the ice passage closure reference should be made to the co-pending application of Robert E. Lindenschmidt, Ser. No. 718,146, filed 8/26/76, entitled "Refrigerator Ice Door Mechanism."

Figure 4:
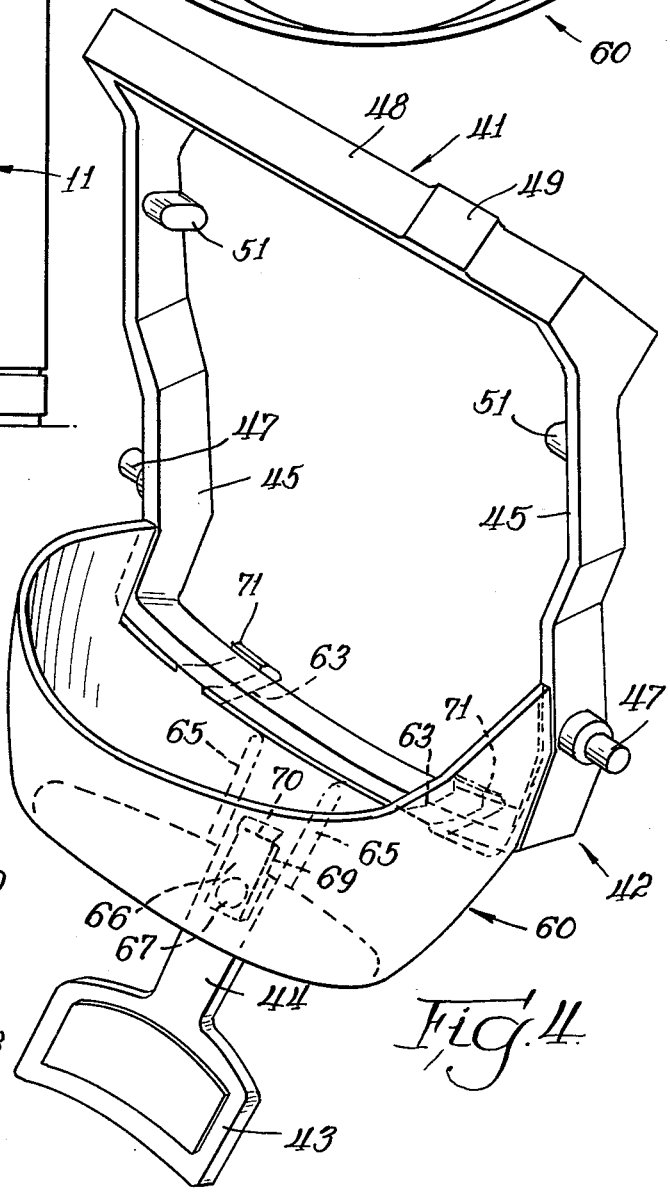
FIG. 4 is a perspective view of the assembled actuator and guide.
Figure 2:
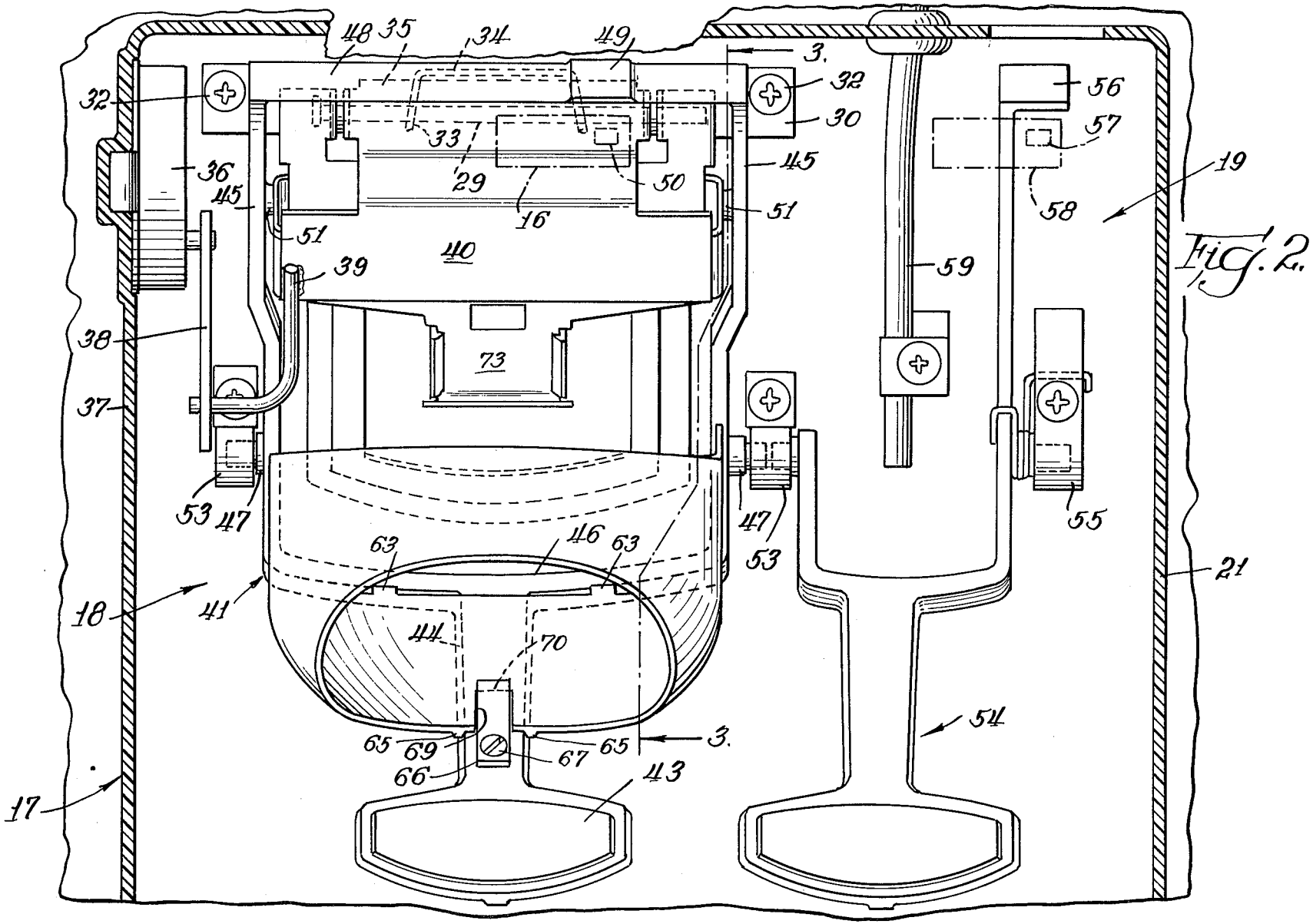
FIG. 2 is a fragmentary enlarged front elevation of the ice delivery means.

To effect desired dispensing of the ice pieces 15 such as to the receptacle 20, actuation of switch 16 and movement of the closure 28 to the open position of FIG. 3 are effected by means of an actuator generally designated 41 which is shown in greater detail in FIG. 4. As shown, the actuator includes a pivot portion 42, an engagement portion 43, and a tongue 44 connecting the engagement portion to the pivot portion. As best seen in FIG. 2, the tongue narrows downwardly toward the engagement portion. The pivot portion 42 comprises a U-shaped portion having legs 45 and a bight 46, the tongue being connected to the midportion of the bight, as best seen in FIG. 4. The pivot portion includes a pair of outwardly projecting pivots 47 on the legs 45.

As further shown in FIG. 4, the actuator further includes an upper cross bar 48 extending between the upper end of the legs 45 and provided with an actuator shoulder 49. As shown in FIG. 3, the actuator shoulder 49 is adapted to engage the actuator 50 of the switch 16 when the actuator is pivoted to bring the cross bar portion 48 forwardly, to effect the delivery of ice pieces from the ice maker in the ice delivery operation.

Legs 45 are further provided with lugs 51 which, as shown in FIG. 3, engage a drive portion 52 of the carrier 73 to swing the closure 28 to the open position during the ice delivery operation.

As shown in FIG. 2, the pivots 47 are received in complementary journals 53 mounted to the housing 21 for pivotally mounting the actuator to the housing. As further illustrated in FIG. 2, the ice water delivery mechanism may include a modified actuator generally designated 54 pivotally mounted to the inner journal 53 and a third journal 55 on the housing. The actuator includes a switch actuating portion 56 adapted to engage the switch actuator 57 of a switch 58 for controlling the delivery of ice water from the refrigerator through a delivery tube 59 extending through the housing 21 as further illustrated in FIG. 3.

As illustrated in FIG. 3, the ice pieces 15 delivered downwardly and forwardly through the chute 23 are directed against the closure 28 which effectively deflects them downwardly toward the receptacle 20. It has been found, however, that the inertia forces and irregular shape of the ice pieces may, at times, cause the deflection of the ice pieces substantially laterally from the space directly above the receptacle whereby such pieces are not properly delivered into the receptacle during the dispensing operation.

Figure 6:
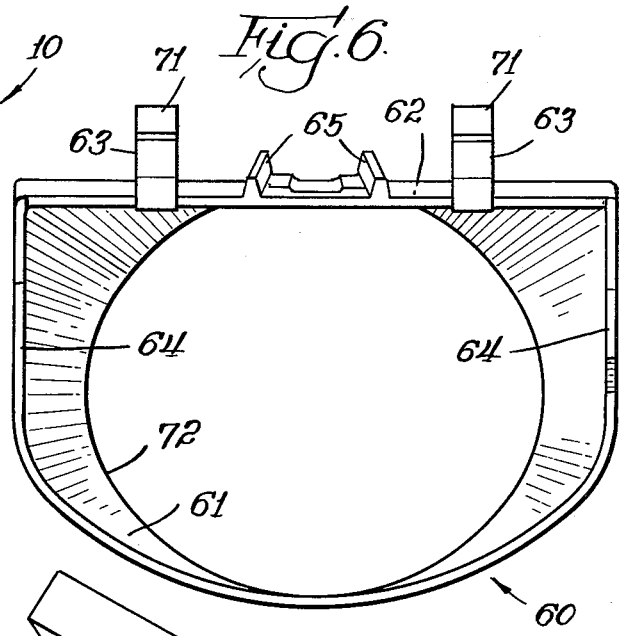
FIG. 6 is a top plan view of the guide.
Figure 7:
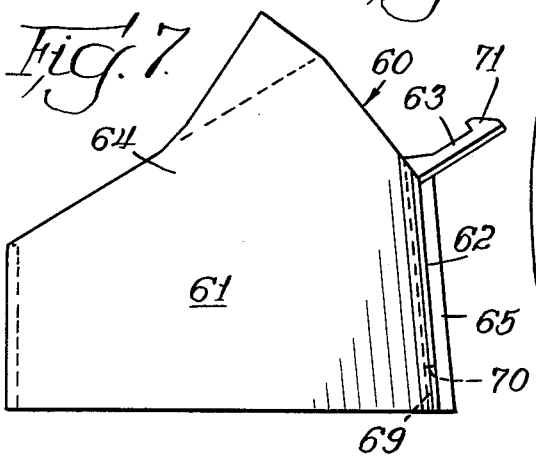
FIG. 7 is a side elevation of the guide.

The present invention comprehends the provision of an improved guide generally designated 60 which cooperates with the closure 28 in providing an effectively positive delivery of the ice pieces to the receptacle 20 notwithstanding the erratic deflection thereof by the closure 28 during the ice piece dispensing operation. As shown in FIG. 4, the guide 60 is mounted to the actuator 41 for movement therewith. As best seen in FIGS. 6 and 7, the guide includes a generally tubular guide portion 61, a rear mounting portion 62, interlocking means 63, and an upstanding, generally triangular side wall portion 64. The guide may be formed as a one-piece molded element of synthetic resin. The guide is adapted to be snap-mounted to the actuator for facilitated installation and removal as desired.

Figure 5:
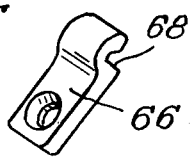
FIG. 5 is a perspective view of the stop means thereof.

Mounting portion 62 of the guide is defined by a pair of ribs 65 which converge downwardly so as to be complementary to the downwardly tapering tongue portion 44 of the actuator received therebetween in the installed arrangement of the guide on the actuator tongue. As shown in FIG. 2, the actuator tongue 44 is provided with a stop 66 which may be secured thereto by a pin 67. As shown in FIG. 5, the stop includes an upper undercut portion 68. The guide mounting portion 62 is provided with a notch 69 which, in the installed arrangement of the guide, is fitted about the stop 66 with the portion 70 of the guide above the notch defining a lip received in the undercut portion 68 of the stop.

As further shown in FIG. 4, the interlock means 63 comprises a pair of resilient fingers projecting rearwardly from the mounting portion 62 to underlie the actuator bight portion 46 and thereby resiliently retain the guide lip 70 against the undercut portion 68 of the stop 66. The spring fingers may include turned end portions 71 abutting the rear surface of the bight 46 and thereby preventing forward tipping of the guide away from the actuator in use.

As best seen in FIG. 3, the triangular upstanding side wall portions 64 of the guide extend to laterally of the space 27 rearwardly of the closure 28 so as to effectively preclude movement of the ice pieces laterally from the space as a result of the erratic deflection thereof by the closure 28. Thus, in the ice delivering arrangement of FIG. 3, the closure 28 and guide 60 cooperate to provide a generally tubular extension of the chute 23 assuring effective delivery of the ice pieces to the receptacle 20.

As further shown in FIG. 3, the mounting wall portion 62 of the guide extends angularly downwardly and forwardly in the ice dispensing position so that ice pieces deflected by closure 28 downwardly are urged downwardly and forwardly by the engagement thereof with the rear wall portion 62 so as to more effectively be delivered into the receptacle 20, as shown in FIG. 3.

Still further, the guide 60 provides an improved ice piece guiding functioning at the time of removal of the receptacle 20 from the actuator portion 43. Thus, withdrawal of the receptacle forwardly therefrom, or to the left as seen in FIG. 3, causes the actuator to be pivoted in a clockwise, or outward, direction by the spring 33 thus tending to swing the guide 60 similarly in a clockwise direction about the pivot rod 29 so as to direct the last ice pieces in the delivey operation more forwardly and thereby into the receptacle 20 as it is being withdrawn. The clockwise pivoting of the actuator concurrently causes the closure 28 to swing in a counterclockwise direction, as seen in FIG. 3, thereby deflecting the last ice pieces more positively against the rear wall portion 62 of the guide 60, thereby augmenting the forward directing action of the guide during this phase of the ice delivery operation.

In the illustrated embodiment, the guide 60 and the stop 66 together further serve as stop means for limiting the movement of the receptacle 20 along the presser portion 43 of the acutator, as shown in FIG. 3, thereby effectively maintaining a desired positioning of the receptacle 20 subjacent the guide 60 for improved effective positive delivery of the ice pieces 15 to the receiver.

As best seen in FIG. 6, the guide 60 preferably has a lateral extent substantially greater than the fore-and-aft extent to provide improved control of the laterally deflected ice pieces for improved delivery thereof through the central opening 72 of the guide. The upper portion of the guide may be relatively larger than the opening so as to effectively provide a funneling action in the guiding of the ice pieces to the receiver 20.

The foregoing disclosure of specific embodiments is illustrative of the broad inventive concepts comprehended by the invention.

Having described the invention, the embodiments of the invention in which an exclusive property or privilege is claimed are defined as follows:

1. In an ice dispensing apparatus having a wall provided with an opening, apparatus for delivering ice pieces outwardly through said opening, and actuating means carried by the wall for selectively actuating said apparatus, the improvement comprising:

closure means for selectively closing said opening;

guide means; and means for selectively positioning said closure means and said guide means separately of one another to cooperatively define directing means for directing the ice pieces away from said opening to a preselected delivery area concurrently with operation of said actuating means.

2. The ice dispensing apparatus of claim 1 wherein said actuating means includes means for removing said closure means from said opening concurrently with operation of said actuating means.

3. The ice dispensing apparatus of claim 1 wherein said guide means is tubular having generally triangular side portions extending to adjacent said wall for preventing lateral bypassing of said guide by ice pieces delivered from said opening.

4. The ice dispensing apparatus of claim 1 wherein said directing means comprises a directing chute having an axis extending downwardly from said opening.

5. In an ice dispensing apparatus having a wall provided with an opening, apparatus for delivering ice pieces outwardly through said opening, and actuating means carried by the wall for selectively actuating said apparatus, the improvement comprising: closure means for selectively closing said opening; guide means; and means for selectively positioning said closure means and said guide means to cooperatively define directing means for directing the ice pieces away from said opening to a preselected delivery area concurrently with operation of said actuating means, said directing means comprising a directing chute having an axis extending downwardly from said opening, said closure means defining a deflector wall spaced outwardly from said opening for deflecting ice pieces inwardly to said guide means.

6. The ice dispensing apparatus of claim 1 wherein said guide means is snap-fitted to said actuating means.

7. In a refrigerator having a cabinet defining a refrigerated compartment having an opening, means for making ice pieces within said cabinet, ice piece dispensing apparatus within said cabinet, a cabinet door for selectively closing said cabinet opening, said door defining an outer ice service area, ice passage means defining an ice delivery passage extending through said door for delivering ice pieces from said dispensing apparatus to said ice service area, actuating means, mounting means for movably mounting the actuating means on said door at said ice service area to be movable between a first position and a second position, closure means for selectively closing said ice delivery passage when said actuating means is in said first position, and means responsive to disposition of said actuating means in said second position for causing ice pieces to be delivered from said dispensing apparatus to said ice passage means, the improvement comprising guide means carried by said actuating means and movable therewith selectively independently of said closure means for guiding the delivered ice pieces from said ice passage means to a preselected ice delivery area within said ice service area.

8. In a refrigerator having a cabinet defining a refrigerated compartment having an opening, means for making ice pieces within said cabinet, ice piece dispensing apparatus within said cabinet, a cabinet door for selectively closing said cabinet opening, said door defining an outer ice service area, ice passage means defining an ice delivery passage extending through said door for delivering ice pieces from said dispensing apparatus to said ice service area, actuating means, mounting means for movably mounting the actuating means on said door at said ice service area to be movable between a first position and a second position, closure means for selectively closing said ice delivery passage when said actuating means is in said first position, and means responsive to disposition of said actuating means in said second position for causing ice pieces to be delivered from said dispensing apparatus to said ice passage means, the improvement comprising guide means carried by said actuating means and movable therewith for guiding the delivered ice pieces from said ice passage means to a preselected ice delivery area within said ice service area, said guide means being removably mounted to said actuating means, said structure further including means responsive to movement of said actuator to said second position for operating said closure means to open said ice delivery passage, said guide means and said closure means cooperatively defining a substantially continuous extension of said ice delivery passage for effectively preventing undesirable delivery of the ice pieces away from said preselected delivery area.

9. In a refrigerator having a cabinet defining a refrigerated compartment having an opening, means for making ice pieces within said cabinet, ice piece dispensing apparatus within said cabinet, a cabinet door for selectively closing said cabinet opening, said door defining an outer ice service area, ice passage means defining an ice delivery passage extending through said door for delivering ice pieces from said dispensing apparatus to said ice service area, actuating means, mounting means for movably mounting the actuating means on said door at said ice service area to be movable between a first position and a second position, closure means for selectively closing said ice delivery passage when said actuating means is in said first position, and means responsive to disposition of said actuating means in said second position for causing ice pieces to be delivered from said dispensing apparatus to said ice passage means, the improvement comprising: guide means carried by said actuating means and movable therewith for guiding the delivered ice pieces from said ice passage means to a preselected ice delivery area within said ice service area; and biasing means for biasing the actuating means to said position, said actuator first position being forwardly of said second position, said guide means defining an outlet opening directed downwardly in said second position of said actuating means and angularly and forwardly in said first position thereof, said biasing means causing the actuating means and guide means thereon to move toward said first position immediately upon a release of the actuating means in said second position.

10. In a refrigerator having a cabinet defining a refrigerated compartment having an opening, means for making ice pieces within said cabinet, ice piece dispensing apparatus within said cabinet, a cabinet door for selectively closing said cabinet opening, said door defining an outer ice service area, ice passage means defining an ice delivery passage extending through said door for delivering ice pieces from said dispensing apparatus to said ice service area, actuating means, mounting means for movably mounting the actuating means on said door at said ice service area to be movable between a first position and a second position, closure means for selectively closing said ice delivery passage when said actuating means is in said first position, and means responsive to disposition of said actuating means in said second position for causing ice pieces to be delivered from said dispensing apparatus to said ice passage means, the improvement comprising: guide means carried by said actuating means and movable therewith for guiding the delivered ice pieces from said ice passage means to a preselected ice delivery area within said ice service area; and securing means for removably securing the guide means to the actuating means, said actuator including a portion adapted to be engaged by a receptacle for securing ice pieces delivered from the ice passage means, and said securing means further comprises stop means for limiting movement of the receptacle toward said ice delivery passage.

11. In a refrigerator having a cabinet defining a refrigerated compartment having an opening, means for making ice pieces with said cabinet, ice piece dispensing apparatus within said cabinet, a cabinet door for selectively closing said cabinet opening, said door defining an outer ice service area, ice passage means defining an ice delivery passage extending through said door for delivering ice pieces from said dispensing apparatus to said ice service area, actuating means, mounting means for movably mounting the actuating means on said door at said ice sevice area to be movable between a first position and a second position, closure means for selectively closing said ice delivery passage when said actuating means is in said first position, and means responsive to disposition of said actuating means in said second position for causing ice pieces to be delivered from said dispensing apparatus to said ice passage means, the improvement comprising guide means carried by said actuating means and movable therewith for guiding the delivered ice pieces from said ice passage means to a preselected ice delivery area within said ice service area, said actuating means comprising a lever, said mounting means comprising pivot means mounted below said ice passage means, and said guide means being movable about the pivot axis of said pivot means.

12. In an apparatus for delivering ice pieces having an actuator provided with a mounting portion, an engagement portion, and a tongue connecting the engagement portion to the mounting portion, a guide for guiding ice pieces to a preselected service area, said guide comprising a one-piece element having a tubular guide portion, a mounting portion defining a rearwardly opening channel for embracing said actuator tongue, yieldable interlock means interlocking with said actuator, and shoulder means abutting said actuator in opposition to said yieldable interlock means for yieldingly retaining the guide on said acutator.

13. The apparatus of claim 12 wherein said actuator tongue is provided with a stop, said guide shoulder means abutting said stop.

14. The apparatus of claim 12 wherein said shoulder means comprises a notch in said mounting portion of the guide.

15. The apparatus of claim 12 wherein said interlock means comprises spring finger means releasably engaging said mounting portion of the actuator.

16. The apparatus of claim 12 wherein said guide has a lateral extent substantially greater than the forward-rearward extent.

17. The apparatus of claim 12 wherein said tongue comprises a downwardly narrowing lever and said channel comprises complementary downwardly narrowing channel.

18. The apparatus of claim 17 wherein said channel comprises a pair of ribs extending rearwardly of said guide mounting portion.

* * * * *

UNITED STATES PATENT AND TRADEMARK OFFICE

CERTIFICATE OF CORRECTION

PATENT NO. : 4,102,660

DATED : July 25, 1978

INVENTOR(S) : Leo G. Beckett and William J. Buchser

It is certified that error appears in the above-identified patent and that said Letters Patent are hereby corrected as shown below:

Column 8, Claim 9, line 47, after "angularly" insert --downwardly--.

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*